United States Patent [19]

Szasz et al.

[11] 4,018,356

[45] Apr. 19, 1977

[54] FLOATING DECK FOR LIQUID STORAGE TANK

[76] Inventors: I. Emery Szasz, 7431 Kingsley Road, Montreal, Quebec; Edmund B. Sandborn, 1001 rue de Kingston, No. 34, Boucherville, Quebec, both of Canada

[22] Filed: May 28, 1976

[21] Appl. No.: 690,836

[52] U.S. Cl. ..... 220/220; 220/222; 361/215

[51] Int. Cl.[2] ..... B65D 87/20

[58] Field of Search ..... 220/216–227; 52/3, 5, 81, 82; 61/.5, 1 F; 4/174.12–174.14; 317/2 R

[56] References Cited

UNITED STATES PATENTS

| | | | |
|---|---|---|---|
| 1,650,340 | 11/1927 | Glass | 220/221 |
| 2,873,042 | 2/1959 | Fino | 220/222 |
| 2,919,047 | 12/1959 | Fino | 220/222 |
| 3,029,971 | 4/1962 | Reynolds | 220/218 |
| 3,036,342 | 5/1962 | Fino | 220/218 X |
| 3,134,501 | 5/1964 | Bowley | 220/218 |
| 3,493,143 | 2/1970 | Thompson et al. | 220/218 |
| 3,910,452 | 10/1975 | Szasz | 220/216 X |
| 3,942,674 | 3/1976 | Nelson | 220/221 |

OTHER PUBLICATIONS

*Popular Mechanics*, vol. 111, No. 3, Mar. 1959, p..274, "'Floating Roof' Roof in Tank Reduces Vapor Losses."

*Primary Examiner*—George L. Lowrance
*Assistant Examiner*—Stephen Marcus

[57] ABSTRACT

The disclosure herein describes a floating deck for use in a liquid storage tank, which comprises a generally circular planar platform formed of a plurality of interconnected modular units made of cellular foam plastic; the modular units are of different shape and include at least: a first series of panels, each being in the form of a truncated triangle and a second series of panels, each having a shape that includes at least a parallelogram portion and a small triangular shaped portion outwardly projecting from one side of the parallelogram portion at the upper end thereof; the triangular-shaped portion has a dimension which corresponds to the truncated portion of the triangle of the first series of panels so as to form a continuous platform when both series of panels are interconnected to one another. Other shapes of panels are also disclosed.

18 Claims, 12 Drawing Figures

FLOATING DECK FOR LIQUID STORAGE TANK

FIELD OF THE INVENTION

The present invention relates to floating decks for use in a liquid storage tank and, more particularly, relates to improvements in the construction of such decks which are supported upon the surface of volatile liquids contained in storage tanks.

BACKGROUND OF THE INVENTION

There is described in U.S. Pat. No. 3,910,452, issued Oct. 7, 1975 to one of the present applicants, a floating deck which is adapted to be supported upon the surface of volatile hydrocarbon liquids and which serves to prevent loss of liquids to the atmosphere as a result of surface evaporation due to differential vapor pressures and solar heat. Such floating deck consists of a plurality of concentric groups of interconnected panels wherein each panel is shaped in the form of an isosceles triangle.

It has been found that the apex portion of these triangles, which are made of cellular foam plastics, lacks in rigidity and frequently breaks during assembly or even in storage.

Another problem associated with the floating deck of the type described in the above mentioned U.S. patent is the great number of individual units which are required when decks of large diameter are required.

OBJECTS AND STATEMENT OF THE INVENTION

It is an object of this invention to provide a novel construction for a floating deck for use in a liquid storage tank, which overcomes the above-noted disadvantages of panels made in the form of an isosceles triangle.

It is a further object of this invention to provide in a floating deck modular units of various shapes and sizes so as to reduce to a minimum the number of units required in forming a platform, thereby reducing the assembly time of a floating deck.

The present invention therefore relates to a floating deck which comprises, in its broadest aspect, a first series of panels, each being in the form of a truncated triangle, and a second series of panels, each having a shape that includes at least a parallelogram portion and a small triangular-shaped portion outwardly projecting from one side of the parallelogram portion at the upper end thereof; the small triangular-shaped portion has a dimension corresponding to the truncated portion of the triangle of the first series of panels so that once interconnected to one another the panels form a continuous platform.

In one preferred form of the invention, the truncated triangle of the first series of panels and the small triangular-shaped portion of the second series of panels, when in assembly, define an isosceles triangle, thereby achieving the objects set forth in the above-noted U.S. patent of one of the applicants.

It is pointed out that the expression "truncated" should be used in its broadest sense in that an apex portion of the triangle is missing and that the resulting truncated portion does not necessarily include two bases which are parallel to one another and, consequently, that its two sides are of same length. As described hereinbelow, it is only required that the small triangular-shaped portion of the second series of panels be the complement of the truncated triangle so that, once assembled, they form a complete triangle. Preferably, this assembled triangle is an isosceles triangle.

Other shapes of modular units may be formed and will be described in greater detail in the following description.

Other objects and further scope of applicability of the present invention will become apparent from the detailed description given hereinafter; it should be understood, however, that the detailed description while indicating preferred embodiments of the invention is given by way of illustration only since various changes and modifications within the spirit and scope of the invention will become apparent to those skilled in the art from this detailed description.

DESCRIPTION OF PREFERRED EMBODIMENTS

Figure 1:
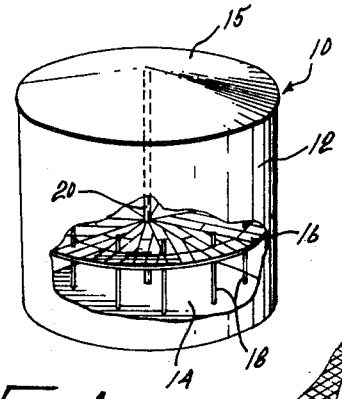
FIG. 1 is a perspective view of a storage tank with its wall partly broken away to show a floating deck therein made in accordance with the present invention.

Referring to FIG. 1, there is shown a storage tank 10 formed of a cylindrical vertical wall 12, a floor 14 and a roof 15. The storage tank 10 further includes a deck 16 which is adapted to float on the stored liquid inside the tank. In FIG. 1, the storage tank is shown empty and the deck 16 rests over floor 14 by means of supporting legs 18 located at predetermined locations along the deck. Although not shown in the drawings, the storage tank further includes inlet and outlet ports for receiving and dispensing the stored product, and one or more manholes to allow servicemen to enter the tank and to clean the tank bottom when the storage tank is empty. A central pillar 20 or a multiplicity of pillars that extend through the deck 16 may or may not be provided.

Figure 11:
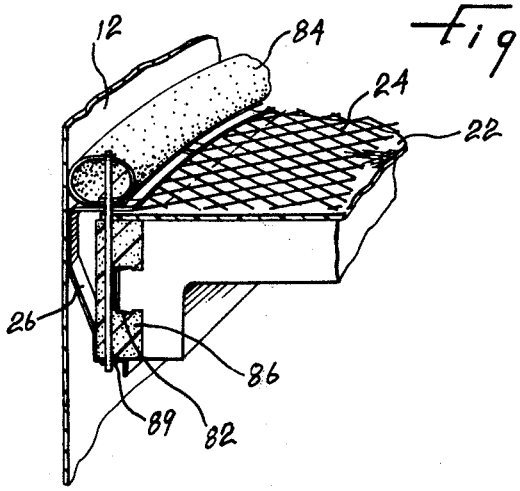
FIG. 11 is a side perspective partial view of the end of a platform in sealing engagement with a storage tank wall.

The deck 16 is a generally circular planar platform which is formed of a plurality of interconnected modular units; each unit is made of cellular foam plastic. In one preferred form, the material used is preformed from a polymeric isocyanate based urethane foam of low density and possessing fire retardant and self-extinguishing properties. The material must be inert to the liquid upon which it floats and possess adequate mechanical strength so that it may be used as a working platform. Once assembled, the modular units are covered with a layer 22 of fire proof material, such as sheets of asbestos. This layer 22 is topped by an expanded metal screen 24 which provides a solid surface to walk on and which is connected to circumferentially spaced metal strips 26 (see FIG. 11) that contact the tank wall 12 to dissipate static electricity.

The platform of interconnected modular units will vary in size in accordance with the diameter of the storage tank. The selection and arrangement of various types of modular units will therefore depend on the size of the tank.

Figure 2:
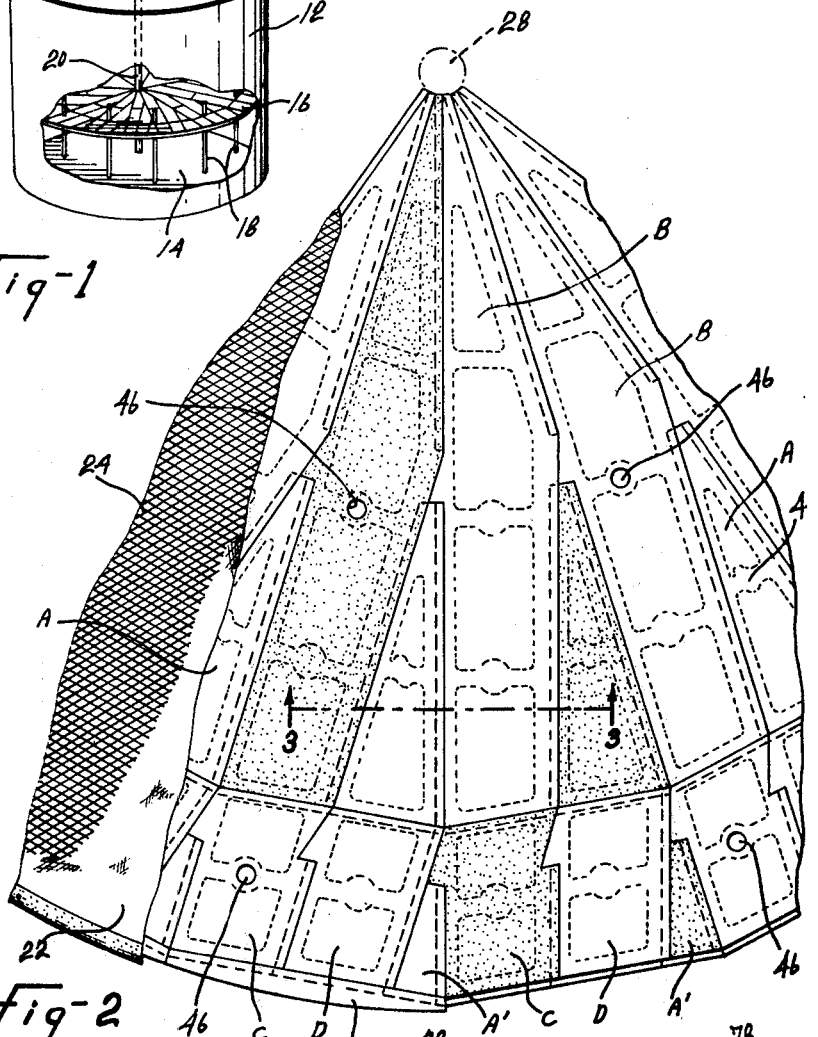
FIG. 2 is an enlarged top view of part of a circular platform made of modular units in accordance with the present invention.
Figure 3:
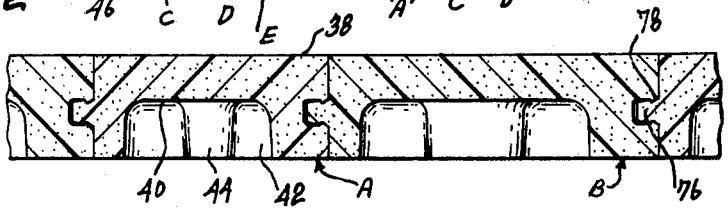
FIG. 3 is a cross-sectional elevation view taken along lines 3—3 of FIG. 2.

Referring to FIG. 2, there is shown one example of an arrangement of interconnected modular units. This section of a platform is formed of six modular units, denoted A,B,C,D, E,A'; differing in shape and in size. This is not the smallest platform that can be assembled; indeed, one example of a smaller platform would consist of a series of radially adjacent panels A wherein each panel would be in the form of an isosceles triangle, each triangle being truncated to leave an opening allowing passage for the central pillar 20.

Figure 6:
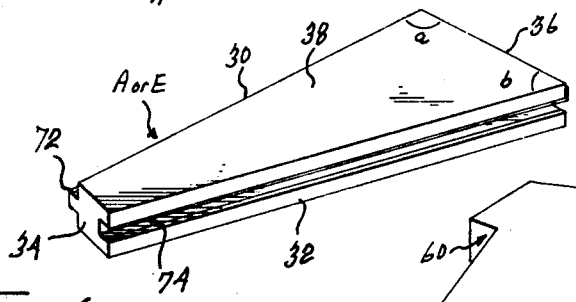
FIGS. 6, 7, 8 and 9 show top perspective views of four panels representative of four different series of panels made in accordance with the present invention.

Panels A and A' have the same geometrical form, but are of different size; panel A' has been shortened somewhat to fit the predetermined radius of the platform in accordance with the size of the storage tank in which the floating cover is to be provided. Panel A is illustrated in FIG. 6 and represents one preferred form of a panel made in accordance with the present invention. This panel is in the form of a truncated triangle having sides 30 and 32 and bases 34 and 36. It should be noted that the truncated triangle needs not be of a trapezoidal shape, i.e. it is not necessary for bases 34 and 36 to be parallel to one another or that sides 30 and 32 be equal. However, angles *a* and *b* should be equalled. Panel A (as well as the other panels described hereinafter) has a planar upper surface 38 and an undersurface 40 provided with a transverse rib 42 which serves to reinforce the panel and which form pockets to trap vapor dissipating from the product stored in the tank. Rib 42 includes an enlarged central portion 44 so that, on some ribs, holes 46 may be provided to receive the supporting legs 18.

Figure 8:
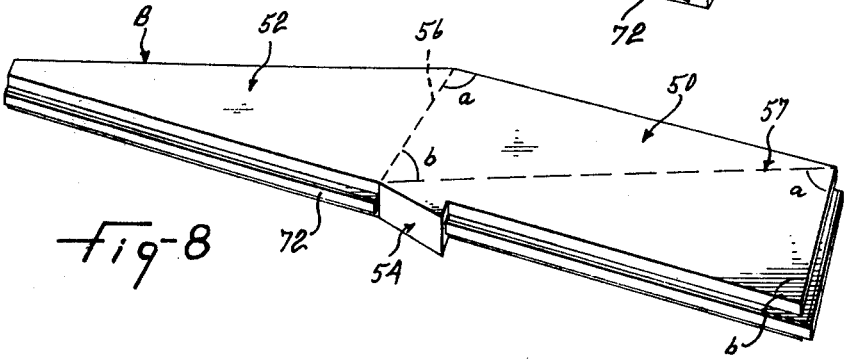

The platform of FIG. 2 is also made of another series of panels B. As illustrated in FIG. 8, panel B includes a lower portion 50 defining a parallelogram and an upper portion 52 defining a truncated triangle having a shape corresponding to panel A (dotted lines 56 show the two geometrical shapes). The parallelogram portion of panel B further includes a small triangular-shaped portion 54 which projects outwardly from one side adjacent the upper end of the parallelogram portion. This triangular-shaped portion has a dimension corresponding to the truncated apex portion of the truncated triangle of panel B so that, as illustrated in FIG. 2, when panels A and B are assembled together, a continuous surface is formed. The parallelogram 50 is a rhomboid figure with oblique angles and unequal adjacent sides and includes two inverted adjacent isosceles triangles as illustrated by dotted lines 57. Angles *a* and *b* are again found reproduced in this shape. However, this geometrical relationship is no longer true should it be required to cut away a portion of parallelogram 50 to form a deck of smaller diameter than that represented in FIG. 2; such deck would include panels B and A' since panels A would also have a cut-off portion. In this example, the cut line of each panel would be parallel to the base of its panel.

It can be seen that the platform illustrated in FIG. 2 could further be made of a smaller diameter if the platform included only panels A and B.

Figure 7:
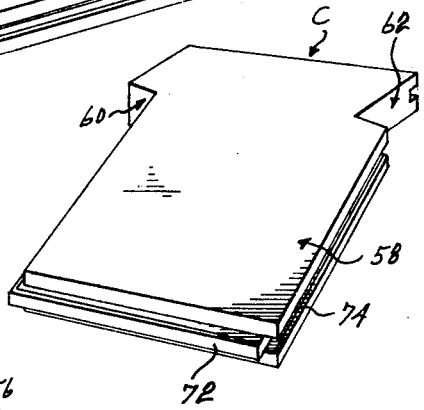

The platform shown in FIG. 2 further includes a series of panels C, each having a parallelogram shape. Referring to FIG. 7, panel C includes a small triangular outwardly projecting portion 60 of identical shape and size to the triangular-shaped portion 54 of panel B and with a dimension corresponding to the truncated portion of panel A so that, when assembled together, panels A and C (or A' and C) define a continuous surface. Panel C is further provided, adjacent the upper end thereof and on the opposite side to small portion 60, with a small triangular-shaped recess 62 which is adapted to receive the small triangular-shaped portions, such as 54 or 60 of other panels.

Panel D is structured identically to panel C with the exception that no recess 62 is provided on one side of the panel.

Figure 4:
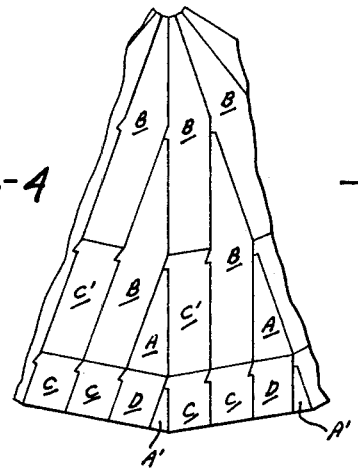
FIGS. 4 and 5 are schematic representations of other arrangements of modular units to form platforms in accordance with the present invention.
Figure 5:
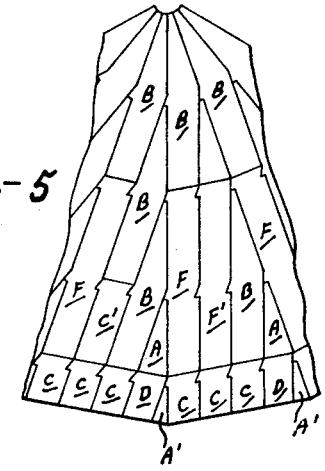
Figure 9:
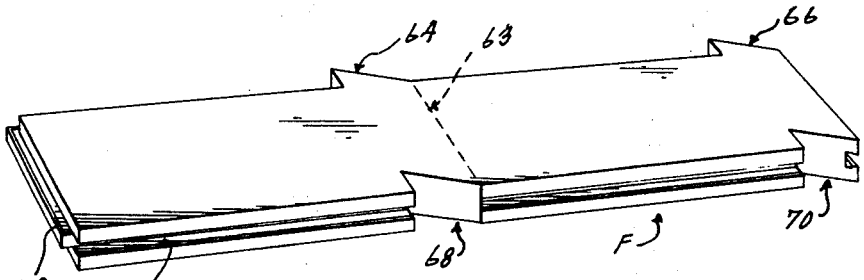

Referring to FIGS. 4 and 5, there are shown, as examples, two other possible arrangements of panels to form a circular platform in accordance with the present invention; panels referred to by a letter and prime mark indicate that they correspond in shape to panels of corresponding reference letters but vary in size. FIG. 4 includes, for example, panels C' each having the basic parallelogram shape as that of lower portion 50 of panel B. This panel C' includes therewithin the two isosceles triangles defining by the sides, base and dotted lines 56 and 57 represented in FIG. 8. It should be noted that panel C, being of a shorter dimension than that of panel C', does not have this geometrical relationship even though it is a parallelogram. FIG. 5 shows, for example, a further series of panels F (see FIG. 9) which individually may consist of two contiguous panels C' integrally mounted to one another (as represented by dotted lines 63). Panel F is a parallelogram that includes two small longitudinally spaced triangular-shaped projecting portions 64 and 66 and two small longitudinally spaced triangular-shaped recesses 68 and 70. Portions 64 and 68 of panel F are identical to portions 54 or 60 of panels B and C while recesses 68 and 70 of panel F are identical to recess 62 of panel C.

Although not shown, a panel D' could be provided having the same size as panel C' and the shape of panel D. Referring to FIG. 5, a panel F' could be provided with two projecting portions but with only one recess at the mid portion of one side thereof.

Each of the above described type of panels may be interconnected by means of male and female engaging profiles, such as tongues 72 and grooves 74, extending on sides and bases of the panels. However, no tongues or grooves need be provided on base 34 of panel A, on the small triangular portions 54, 60, 64 and 66 and in recesses 62, 68 and 70. To secure the interlocking of the panels to one another, the tongues and grooves are provided with cooperating shoulders 76 and lips 78 which should have sufficient obliquity that the tip of shoulder 76 will enter the opening of the groove 74 to allow a snap-in engagement by simple pressure. The panels are thus interlocked to one another by snapping the tongue in the groove except for the first triangles A and triangular portions of panels B (which can be engaged by sliding in one another) or the last peripheral triangles, be they A or A', which are inserted by a combined sliding and snapping motion. As an alternative, locating pins and holes on the panels could also be used instead of the tongue-and-groove arrangement described above to interlock the panels. Also, to provide adequate sealing between the interlocked panels, an epoxy adhesive is preferably applied to the sides and bases of the panels prior to assembly. To provide a still more solid platform, the panels may be bolted to one another.

Figure 10:
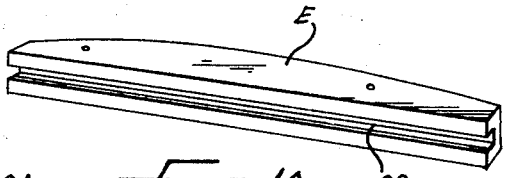
FIG. 10 is a side perspective view of an end piece curved to accommodate the panels to the wall of the tank.

Once the panels are assembled to form a circular platform of predetermined radius, a number of border pieces E are mounted circumferentially to the radially outmost panels to fit the size of the tank. Referring to FIG. 10, end pieces E are provided with a lipped groove 82 which is adapted to slide or snap in the tongues projecting from the said radially outmost panels.

To provide adequate sealing engagement between the deck and the inside wall of the storage tank, a flexible seal 84 is attached to the border pieces E. This seal consists of a resilient sheet of insulating material, such as Ethafoam 220(tm), in predetermined width which is rolled into a round-shaped tube and which is fastened to the rim of the deck by means of a series of circumferentially spaced rods 86 and fasteners 88 and 89. To fit adequately the contour of the tank wall, the shape of the tube may be altered by pushing downward fasteners 88; the tube will thus take an oval shape to close the non-uniform gap between the peripheral rim of the platform and the inner wall of the tank thereby preventing evaporation of volatile liquids from the tank.

Figure 12:
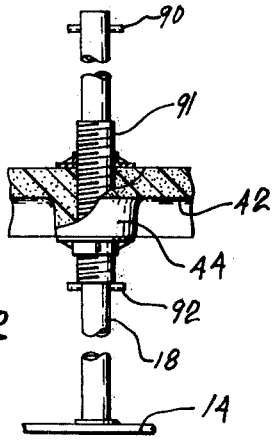
FIG. 12 is an elevation partly cross-sectional view showing the connection of a support leg to a panel.

Referring to FIG. 12, each leg 18 is slidably mounted in a sleeve 91 secured to a panel of the floating deck. Two vertically spaced pins 90 and 92 are provided on the leg; pin 90 causes the leg to be lifted with the deck when the stored product has caused sleeve 91 to contact pin 90 while pin 92 allows the deck to be supported at a predetermined distance from the floor of the tank when the lower end of the leg touches the floor of the tank when the latter is emptied.

What is claimed is:

1. In a floating deck for use in a liquid storage tank, a generally circular planar platform formed of a plurality of interconnected modular units made of cellular foam plastic, said modular units being of different shape and including at least:

a first series of panels, each being in the form of a truncated triangle;

a second series of panels, each having a shape including at least a parallelogram portion and a small triangular-shaped portion outwardly projecting from one side of said parallelogram portion at the upper end thereof; said small triangular-shaped portion having a dimension corresponding to the truncated portion of said truncated triangle of said first series of panels so as to form a continuous platform when said first and second series of panels are interconnected to one another.

2. In a floating deck as defined in claim 1, the shape of said second series of panels further includes an upper portion defining a truncated triangle corresponding in shape to that of said truncated triangle of said first series of panels; the truncated part of said truncated triangle of said upper portion having a dimension corresponding to that of said small triangular-shaped portion of said second series of panels.

3. In a floating deck as defined in claim 1, further comprising a third series of panels, each defining a parallelogram shape and including:

a. two longitudinally spaced small triangular-shaped portions on one side thereof; said small triangular-shaped portions of said third series of panels each having a dimension corresponding to the small triangular-shaped portion of said parallelogram portion of said second series;

b. a small triangular-shaped recess on the opposite side of said panel in the mid-portion thereof, said triangular-shaped recess having a dimension corresponding to the small triangular-shaped portions of any of the previously recited panels whereby said small triangular-shaped portions of any of the previously recited panels may be fittingly received therein.

4. In a floating deck as defined in claim 1 comprising a further series of panels, each having a shape defining a parallelogram including at least:

a. a small triangular-shaped portion outwardly projecting from one side thereof at the upper end thereof;

b. a small triangular-shaped recess provided on the opposite side of said parallelogram at the upper end thereof; said portion and said recess having a shape corresponding to similar triangular-shaped portions on any of the previously recited panels.

5. In a floating deck as defined in claim 1, further comprising a layer of asbestos sheets covering said modular units and a screen of metal extending over said layer.

6. In a floating deck as defined in claim 5, further comprising metal strips circumferentially spaced at the perimeter of said platform and contacting said screen and said storage tank wall for dissipating static electricity.

7. In a floating deck as defined in claim 1, each of said first and second panels including, on one side thereof, male engaging profile means and, on the opposite side thereof, female engaging profile means, said profile means having correspondingly shaped cross-sections whereby adjacent panels may be interconnected in side-by-side arrangement; each said panel further including inter-engaging profile means on bases thereof to connect a base of one panel to a base of a radially adjacent panel.

8. In a floating deck as defined in claim 7, further comprising end pieces circumferentially disposed on said platform, said end pieces having profiles correspondingly engaging the profile means of the bases of outmost radially disposed panels.

9. In a floating deck as defined in claim 8, further comprising sealing means disposed circumferentially on said end pieces for providing an air-tight engagement between the platform and a storage tank wall.

10. In a floating deck as defined in claim 8, further comprising an epoxy adhesive on all sides and bases of at least one of the panels in at least one of said first and second series of panels and on the pieces for further sealingly securing said panels together.

11. In a floating deck as defined in claim 1, wherein at least one of the panels in at least one of said first and second series of panels are moulded from a rigid hard skin polyurethane closed cell foamed material of low cubic density, each said panel having a planar upper surface and having an undersurface provided with reinforcing protruding rib means; said rib means defining vapor trapping pockets.

12. In a floating deck as defined in claim 11, further comprising openings provided in said reinforcing rib means to slidably receive therein supporting legs for supporting said platform on the bottom of the liquid storage tank.

13. In a floating deck for use in a liquid storage tank, a generally circular planar platform formed of a plurality of interconnected modular units made of cellular foam plastics, said modular units being of different shape and including at least:

a first series of panels, each being in the form of a truncated triangle;

a second series of panels, each having a shape consisting of a. an upper portion defining a truncated triangle;

b. a lower portion, continuous with said upper portions, defining a parallelogram; and c. a small triangular-shaped portion extending from one side of said lower portion at the upper end thereof; said small triangular-shaped portion having a dimension corresponding to the truncated portion of said truncated triangle of said first series of panels so as to form a continuous surface when said first and second series of panels are interconnected to one another.

14. In a floating deck as defined in claim 13, wherein said truncated triangle of said first series of panels, when assembled to said small triangular portion, defines therewith an isosceles triangle.

15. In a floating deck as defined in claim 13, said small triangular-shaped portion having a dimension corresponding to the truncated portion of said upper portion of said second series of panels.

16. In a floating deck as defined in claim 15, further comprising a fourth series of panels, each defining a parallelogram shape and including:

a. two small triangular-shaped portions extending from one side thereof; said small triangular-shaped portions of said fourth series of panels each having a dimension corresponding to the small triangular-shaped portion of said second series of panels;

b. two small spaced triangular-shaped recesses on the opposite side of said panel, said triangular-shaped recesses each having a dimension corresponding to the small triangular-shaped portions of the any of the previously recited panels whereby said small triangular-shaped portions of any of the previously recited panels may be received in said recesses.

17. In a floating deck as defined in claim 15, further comprising a third series of panels, each defining a parallelogram shape and further including a small triangular-shaped portion extending from one side thereof adjacent the upper end thereof, said small triangular-portion of said third series of panels having a dimension corresponding to the small triangular-shaped portion of said second series of panels.

18. In a floating deck as defined in claim 16, comprising a further series of panels, each defining a parallelogram shape and including:

a. a small triangular-shaped portion extending from one side thereof at the upper end thereof;

b. a small triangular-shaped recess provided on the opposite side of said parallelogram at the upper end thereof; said portion and said recess having identical shape corresponding to similar small triangular-shaped portions on any of the previously recited panels.

* * * * *